United States Patent [19]

Hall et al.

[11] Patent Number: 4,824,100

[45] Date of Patent: Apr. 25, 1989

[54] OPPOSED REBOUNDING EXERCISE DEVICE

[76] Inventors: Lance L. Hall, 1071 E. 800 North, Shelley, Id. 83274; W. Peter Schwarz, 5386 Nevesco, Idaho Falls, Id. 83402

[21] Appl. No.: 28,778

[22] Filed: Mar. 23, 1987

[51] Int. Cl.[4] ..... A63B 5/00; A63B 69/18

[52] U.S. Cl. ..... 272/65; 272/97

[58] Field of Search ..... 272/65, 66, DIG. 9, 272/144, 97, DIG. 4; D21/235; 182/137, 138, 139; D6/360, 361, 375; 248/455, 188, 69

[56] References Cited

U.S. PATENT DOCUMENTS

| | | | |
|---|---|---|---|
| D. 163,449 | 5/1951 | Eiseman | D6/375 |
| D. 279,841 | 7/1985 | Edmondson et al. | D6/360 |
| 847,052 | 3/1907 | Englefield | 248/455 |
| 3,004,623 | 10/1961 | Nissen | 272/65 |
| 3,501,141 | 3/1970 | Nissen et al. | 272/65 |
| 3,716,230 | 2/1973 | Mark | 272/144 |
| 4,045,021 | 8/1977 | Nissen | 272/65 |
| 4,119,311 | 1/1978 | Jenkins et al. | 272/65 |
| 4,483,531 | 11/1984 | Laseman et al. | 272/65 |
| 4,598,905 | 7/1986 | Vrana | 272/65 |
| 4,730,826 | 3/1988 | Sudmeier | 272/97 X |

FOREIGN PATENT DOCUMENTS

| | | | |
|---|---|---|---|
| 1137660 | 11/1956 | Fed. Rep. of Germany | 272/65 |
| 1181675 | 1/1959 | France | 272/144 |

*Primary Examiner*—Richard J. Apley
*Assistant Examiner*—H. Flaxman
*Attorney, Agent, or Firm*—B. Deon Criddle

[57] ABSTRACT

An exercise device having opposed angled rebound surfaces that will fold flat together, and support structure for the surfaces that will also fold compactly. The device also includes adjustable legs which allow angular relation between the rebound surfaces. The adjustment structure includes a lock and sleeve bracket which moves longitudinally on the frame member to accomplish the angular adjustment.

1 Claim, 1 Drawing Sheet

OPPOSED REBOUNDING EXERCISE DEVICE

BRIEF DESCRIPTION OF THE INVENTION

1. Field of the Invention

This invention relates to exercise devices and is particularly concerned with exercise devices that provide for jumping and rebounding off of a taut, spring-suspended flexible surface.

2. Prior Art

Trampolines and ini-type trampolines having rebound surfaces for exercise purposes, have long been known and used. The structures used in the past have generally comprised a taut, flexible sheet material suspended at its periphery with resilient supports. These previously known structures have generally been used by persons jumping on them and using the taut, resiliently suspended surface to achieve a rebound action in a vertical direction. Rebound devices have also been provided in the past in which a single rebound surface may be angled so that a person jumping against the surface will rebound at a desired angle.

More recently, as shown in U.S. Pat. No. 4,483,531, it has been proposed to use a pair of spaced apart mini-trampolines, interconnected by a pair of rails and with angles rebound surfaces as an exercise device.

So far as we are aware, there has not previous to our invention, been known a rebound device having a single rebound sheet that will provide a pair of angular opposed surfaces that will permit a user to jump from one surface to the other surface and to be rebounded back and forth between the surfaces.

OBJECTS OF THE INVENTION

Principal objects of the present invention are to provide an exercise device having a pair of rebound surfaces formed from a single rebound sheet extending angularly from a common central area and supported such that a user can rebound from one surface to the other surface and back. Such rebounding from surface to surface, permits a user to perform jumping exercises, back and forth, without a substantial vertical leap, thereby allowing the structure to be used even in a room having a low ceiling. An exercise device having a pair of rebound surfaces angled, as described, also permits the user to perform exercises that are particularly adapted to exercising the muscles used by a snow skier, waterskier, or skater. The use of a single rebound sheet to form the pair of rebound surfaces permits use of a collapsible support structure to facilitate storage and transportation of the unit.

FEATURES OF THE INVENTION

Principal features of the invention include a support frame that is pivoted at a center section and that has a pair of outer frames adapted to extend upwardly and outwardly from a center line and to be supported by foldable legs.

Other features of the invention include the use of a single rebound sheet to form the pair of rebound surfaces, and the use of folding legs to allow the structure to be compactly folded for the storage and the like.

Still another feature of the invention is the use of a support post, removably attached to the frame, that may be grasped by a user in practicing rebound activities on the device.

Additional objects and features of the invention will become apparent from the following detailed description and drawings, disclosing a presently preferred embodiment of the invention.

THE DRAWINGS

In the drawings:

FIG. 1 is a perspective view of the exercise device of the invention;

FIG. 2, a fragmentary perspective view, taken within the lines 2—2 of FIG. 1, and showing the coupling arrangement at the center of the structure;

FIG. 3, an exploded fragmentary perspective view, taken within the lines 3—3 of FIG. 1; and FIG. 4, a fragmentary section view taken on the lines 4—4 of FIG. 1.

DETAILED DESCRIPTION

Figure 1:
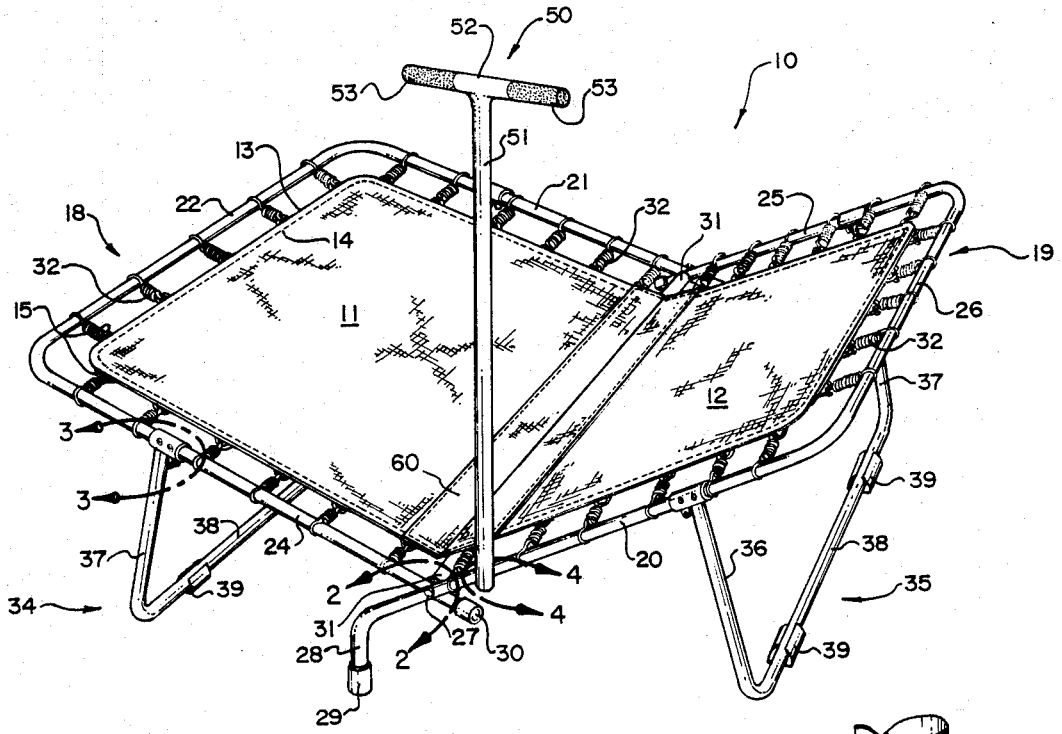

Referring now to the drawings:

The exercise device of the invention, shown generally at 10, comprises a pair of rebound surfaces 11 and 12, that are formed from a single sheet 13 of flexible material such as reinforced nylon. A seam 14 is formed around the periphery of the sheet 13 and D-rings 15 are spaced around the periphery of the sheet 13 and project from the seam 14.

A pair of U-shaped frames 18 and 19 provide support for the sheet 13. Frame 18 includes a pair of legs 20 and 21, interconnected at one of their ends by a web 22. Similarly, frame 19 includes legs 24 and 25, interconnected at one of their ends by a web 26.

Figure 2:
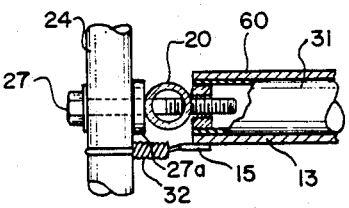

The legs 24 and 25 are pivotally connected to the other ends of the legs 21 and 22, as best shown in FIG. 2. As shown, the legs 20 and 21 are inside legs 24 and 25 and legs 20 and 24 are pivotally connected and legs 21 and 25 are pivotally connected by a bolt 27. A spacer washer 27a is positioned between each pair of legs and serves as a bearing during pivoting of the legs, as will be further described.

The legs 20 and 21 are each curved at their free ends to form center legs 28 for the unit and a protective cap 29 is provided for the end of each leg.

The free ends of legs 24 and 25 extend slightly beyond the bolts 27 and are also capped with a protective cap 30.

Bolts 27, as previously explained, extend as pivot axis through the ends of legs 20 and 24 and 21 and 25 and then are threaded into the ends of a center pipe 31.

The sheet 13 passes beneath the pipe 31 and is stretched taut around its edges by springs 32, each having one end attached to a U-shaped frame 18 or 19 and its other end attached to a D-ring 15.

Figure 3:
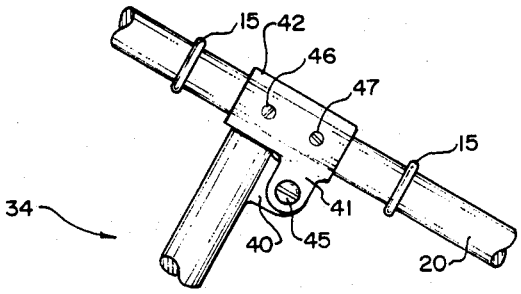

As best shown in FIGS. 1 and 3, folding legs 34 and 35 are respectively attached to the U-shaped frames 18 and 19. Each folding leg includes a pair of tubular side members 36 and 37 with each pair interconnected at ends thereof by a tubular ground member 38 and each ground member has a pair of spaced apart pads 39 mounted thereon. The pads 39 are crimped onto the ground member 38 and rotate thereon.

The other ends of the side member 36 and 37 are each pivotally connected to a leg of a U-shaped member 18 or 19. An ear 40 is provided adjacent each said end of the side members and a corresponding ear 41 projects from a sleeve 42 that is telescoped over and secured to a leg 20, 21, 24 and 25 such that bolts 45 inserted through matching ears 40 and 41 serve as pivot shafts for the pivoted connection between the folding legs and the U-shaped frames 18 and 19.

Each sleeve 42 is slidable along a leg of a U-shaped frame and is locked in desired position by a pair of set screws 46 and 47 that are threaded through the sleeve and into engagement with the leg. With the ears 40 and 41 interconnected the legs 34 and 35 pivot between a use position, as shown in FIG. 1, wherein the ends of the side members 36 and 37 abut the legs 20, 21, 24 and 25 and the side members form substantially right angles with the legs 20, 21, 24 and 25 and a folded position wherein the side members 36 and 37 rest against the legs 20, 21, 24 and 25.

For storage or carrying, the legs 34 and 35 are placed in their folded positions and the U-shaped frames are pivoted together to place the rebound surfaces 11 and 12 in a face-to-face relationship.

In use, the legs are moved to the position of FIGS. 1 and 3 and the sleeves 42 are positioned along their associated legs to set the rebound angle of the rebound surfaces 11 and 12. A user may then jump back and forth between the surfaces 11 and 12.

Figure 4:
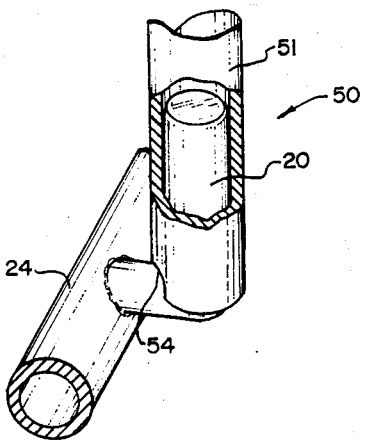

As best shown in FIGS. 1 and 4, a support-T 50 may be provided for grasping by a user of the device, while exercising. The support-T includes a tubular support post 51 and a cross-bar 52 on an upper end thereof. Protective caps 53 are provided on opposite ends of cross-bar 52. A slot 54 is formed in a bottom end of the support post and extends diametrically fully across the member.

Leg 20 has a post 35 affixed thereto. One end of post 55 is welded or otherwise affixed to the leg 20 at a lower end thereof and the other end 55b projects upwardly therefrom. The support-T is positioned by telescoping support post 51 over the post 55 and is locked against turning by positioning slot 54 over the leg 20.

With the support-T positioned as described, the cross-bar 52 may be grasped by a user of the exercise device. A protective cover 60 may be placed over center pipe 31.

Although a preferred embodiment of our invention has been disclosed, it is to be understood that the present disclosure is by way of example and that variations are possible without departing from the subject matter coming within the scope of the following claims, which subject matter we regard as our invention.

We claim:

1. An exercise device comprising a single sheet of strong durable material;

a pair of frame members of generally U-shaped configuration each surrounding the sheet of material, insert - frame member including a pair of spaced apart legs at opposite sides of the sheet of material and a web member at one end of the sheet material whereby the sheet material is within the legs and web members of the frame members, with the ends of the pair of legs of one frame member forming ground engaging center legs for the device; springs spaced around each of the frame members;

means spaced around the sheet of material and coupling said sheet of material to the springs;

means pivotally connecting the legs of one frame member to the legs of the other frame member;

a center post member extending between the legs of one frame member and overlying the center of said sheet of material; and leg means supporting each of said frame members, whereby each of said frame members and the portion of the sheet material carried thereby extend upwardly and outwardly from the center post member, said leg means each comprising a sleeve and lock means mounted to slide on each leg of a frame member, a side member pivotally attached to each sleeve such that the side member will pivot between a position normal to the leg of the frame member and a position extending substantially parallel to the leg member, a ground member interconnecting the side members at the ends of the side members remote from the sleeves, and means to adjustably secure the sleeves to the legs of the frame members for adjustment of the relative angle between the frames when the side members are positioned normal to the leg means of the frames.

* * * * *